United States Patent [19]

Bullock

[11] 4,204,338

[45] May 27, 1980

[54] LAUNDRY DRYER

[75] Inventor: Norman J. Bullock, Prospect, Ky.

[73] Assignee: The W. M. Cissell Manufacturing Company, Louisville, Ky.

[21] Appl. No.: 947,943

[22] Filed: Oct. 2, 1978

[51] Int. Cl.[2] ..... F26B 11/04

[52] U.S. Cl. ..... 34/35; 34/131; 34/133; 432/103; 432/105

[58] Field of Search ..... 432/103, 105, 107; 34/35, 86, 132, 133, 219, 225, 131

[56] References Cited

U.S. PATENT DOCUMENTS

| | | | |
|---|---|---|---|
| 2,651,113 | 9/1953 | Milby et al. | 34/133 |
| 3,959,892 | 6/1976 | Cloud et al. | 34/86 |
| 3,969,070 | 7/1976 | Thompson | 432/105 |
| 3,995,988 | 12/1976 | Freze | 432/105 |
| 4,065,253 | 12/1977 | Bullock | 432/105 |
| 4,122,824 | 10/1978 | Borgran | 126/121 |

*Primary Examiner*—Larry I. Schwartz
*Attorney, Agent, or Firm*—Wood, Herron & Evans

[57] ABSTRACT

An improved laundry dryer having a novel hot air compartment structure that heats recirculated exhaust air and fresh make-up air. The novel hot air compartment structure, in preferred form, includes an attic chamber defined by the dryer's housing. The attic chamber is divided into upper and lower subchambers, a heater housing being positioned within the lower subchamber. The heat source in the heater housing serves to directly heat fresh make-up air and recirculated exhaust air simultaneously within the heater housing, and also serves to heat up the upper and lower subchambers of the attic chamber. The recirculated exhaust air is introduced into the upper subchamber, thereby pre-heating same prior to introduction into the heater housing, and is subsequently introduced into the heater housing in a vertically downward flow path fashion. The fresh make-up air is introduced into the pre-heated lower subchamber, thereby pre-heating same prior to introduction into the heater housing, and is subsequently introduced into the heater housing in a generally horizontal flow path. The vertically downward and horizontal flow path of the exhaust air and make-up air, respectively, into the heater housing provide for intimate admixing of those two air flows within the heater housing. The flow paths of the recirculated exhaust air and fresh make-up air through the hot air compartment structure is controlled by novel port structure which provides optimum contact of the air flows with the heated surfaces of the upper and lower subchambers, and the heater housing, and with the heat source itself, to achieve maximum heat transfer and, thereby, optimum energy use.

8 Claims, 3 Drawing Figures

LAUNDRY DRYER

This invention relates to laundry dryers. More particularly, this invention relates to a novel laundry dryer in which a portion of the warm exhaust air is recirculated back through the dryer's drum.

Laundry dryers are, of course, very well known to the prior art, and have been in use for many years. All laundry dryers are provided with a heat source. The heat source functions to elevate the temperature of make-up air so that the dryer can dry laundry, e.g., clothes or the like, as that heated make-up air is passed through the rotating tumbler or drum within the dryer's housing.

The cost of fueling a laundry dryer of the commercial or industrial type is quite substantial. This is particularly the case with electric or gas fired dryers, electric or gas fired dryers being the common types used in commercial and industrial applications. In recent years the cost of electricity and gas has risen substantially, and this has substantially increased the business operating costs of the dryer owner. Further, in recent years it has become good business practice to conserve as much energy as possible. However, a dryer is, by its very nature, an energy wasting device as the hot air generated has heretofore, in commercial practice, commonly made only a single pass through the laundry dryer's drum before same is exhausted to atmosphere.

It is known to the prior art to recirculate a portion of the warm air generated and used in the drying of laundry within a laundry dryer. In other words, it is known to recirculate a portion of a dryer's warm exhaust air back through the dryer's drum to aid in the laundry drying process. There are various types of warm air recirculation systems for laundry dryers known to the prior art. Typical warm air recirculation systems are those illustrated in U.S. Pat. Nos. 4,065,253; 3,995,988; 3,969,070; and 3,959,892.

It has been the objective of this invention, therefore, to provide an improved and novel warm air recirculation system for a laundry dryer. In accord with this objective, this invention contemplates an improved laundry dryer having a novel hot air compartment structure that heats recirculated exhaust air and fresh make-up air. The novel hot air compartment structure, in preferred form, includes an attic chamber defined by the dryer's housing. The attic chamber is divided into upper and lower subchambers, a heater housing being positioned within the lower subchamber. The heat source in the heater housing serves to directly heat fresh make-up air and recirculated exhaust air simultaneously within the heater housing, and also serves to heat up the upper and lower subchambers of the attic chamber. The recirculated exhaust air is introduced into the upper subchamber, thereby pre-heating same prior to introduction into the heater housing, and is subsequently introduced into the heater housing in a vertically downward flow path fashion. The fresh make-up air is introduced into the preheated lower subchamber, thereby pre-heating same prior to introduction into the heater housing, and is subsequently introduced into the heater housing in a generally horizontal flow path. The vertically downward and horizontal flow paths of the exhaust air and make-up air, respectively, into the heater housing provide for intimate admixing of those two air flows within the heater housing. The flow paths of the recirculated exhaust air and fresh make-up air through the hot air compartment structure is controlled by novel port structure which provides optimum contact of the air flows with the heated surfaces of the upper and lower subchambers, and the heater housing, and with the heat source itself, to achieve maximum heat transfer and, thereby, optimum energy use.

Other objectives and advantages of this invention will be more apparent from the following detailed description taken in conjunction with the drawings in which.

Figure 1:
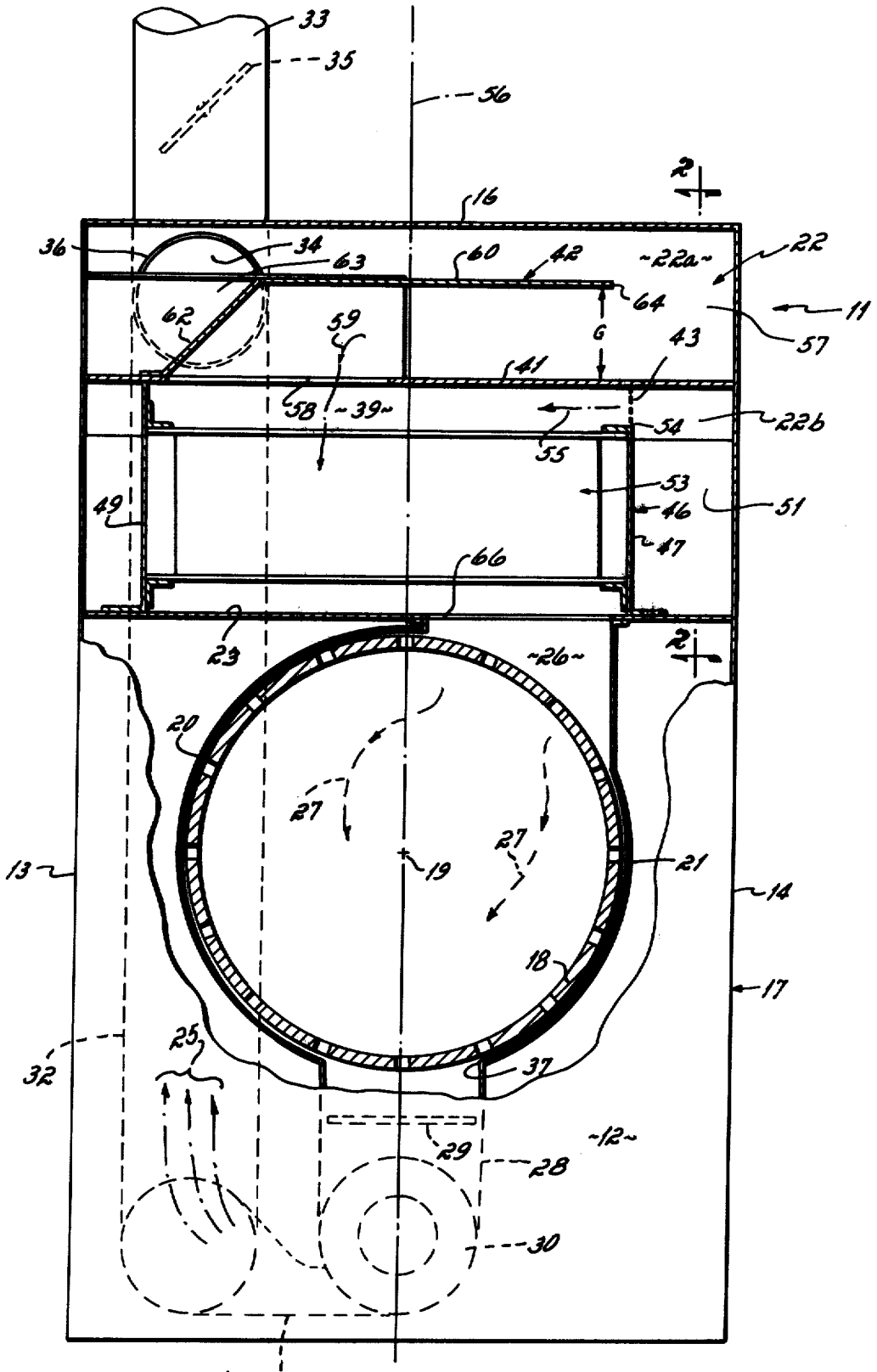
FIG. 1 is a partially broken away front view of a laundry dryer structured in accord with the principles of this invention.

A laundry dryer 10 incorporating the novel hot air compartment structure 11 of this invention includes front wall 12, side walls 13, 14, rear wall 15, and roof 16, all connected together in known fashion to form a housing 17. A perforated laundry drum 18 is disposed within the housing 17, same being adapted to rotate on axis 19 powered by drive means, not shown, all as known and in accord with the prior art. The laundry drum 18 itself is disposed between a left hand shroud 20 and a right hand shroud 21 that cooperate to keep the hot air within the laundry drum.

The hot air compartment structure 11 is located in an attic chamber 22 of the dryer, i.e., within the dryer's housing 17, that attic chamber being defined by the dryer's roof 16, a base floor 23, and the dryer's front 12, side 13, 14, and rear 15 walls.

The hot air compartment 11 is especially structured to heat new or fresh make-up air 24 from outside the dryer, i.e., from the atmosphere, to reheat recirculated warm air 25 which has already been passed through the laundry drum 18, and to admix and reintroduce the admixed make-up air and recirculated air into the laundry drum through hot air duct 26 that connects the attic chamber 22 and the laundry drum. After the hot air has passed through the laundry drum 18 (in accord with the direction arrows 27), same passes into outlet duct 28 and through lint screen 29. The outlet duct 28 includes a blower fan 30 powered by a motor, not shown. The blower fan 30 functions to draw or suck the hot air through the dryer drum 18, and to exhaust same through intermediate duct 31 into exhaust duct 32. The exhaust duct 32 extends vertically upward from adjacent the bottom of the dryer's housing 17, and connects with a stack 33 to atmosphere and a recirculated air duct 34 adjacent the roof 16 of the dryer's housing. A damper 35 is provided in the stack 33 to atmosphere so as to regulate recirculation, into recirculated air duct 34, of the desired portion of the warm exhaust air which has been passed through the dryer's drum 18. Note that the recirculated air duct 34 connects with the rear wall 15 of the dryer's housing 17, and recirculates the warm exhaust air freely back into the attic chamber 11 (through recirculation port 36) within which the hot air compartment 22 of this invention is positioned. Hence, by means of the duct 31, 32, 34 structure, a portion of the warm air exhausted from the dryer's drum 18 through exhaust port 37 is reintroduced into the attic chamber 22, see directional arrows 25, 38 indicating that air flow path for the warm recirculated exhaust air.

New or fresh make-up air also must be introduced into the attic chamber 22 for combining with the recirculated warm air, see directional arrow 24 indicating that air flow path for the fresh make-up air. The make-up air is introduced into the attic chamber 22 through port 39 in rear wall 15 of the dryer's housing 17. The port 39 is covered by a shroud plate 40 that extends downwardly from adjacent the top of the dryer's housing 17 to adjacent the bottom of the dryer's housing, and is fixed to the rear wall 15. The make-up air 24 is thus drawn uqwardly along the rear wall 15 of the dryer's housing, as guided by rear shroud plate 40 fixed to that rear wall, see FIG. 2, so as to preliminarily preheat that make-up air prior to introducing same into the hot air compartment 11 through elongated port 39 in the rear wall of the housing.

Note particularly that the attic chamber 22 of the dryer's housing 17 is divided by intermediate floor 41 into an upper or recirculated air subchamber **22*a* and a lower or make-up air portion subchamber 22*b*. The intermediate floor 41 is fixed in place between the dryer's housing's walls 12–15, thereby preventing access of recirculated air 44 in the upper subchamber 22*a* into the lower subchamber 22*b*, and preventing access of make-up air 45 in the lower subchamber 22*b* into the upper subchamber 22*a***, described in greater detail below.

Figure 3:
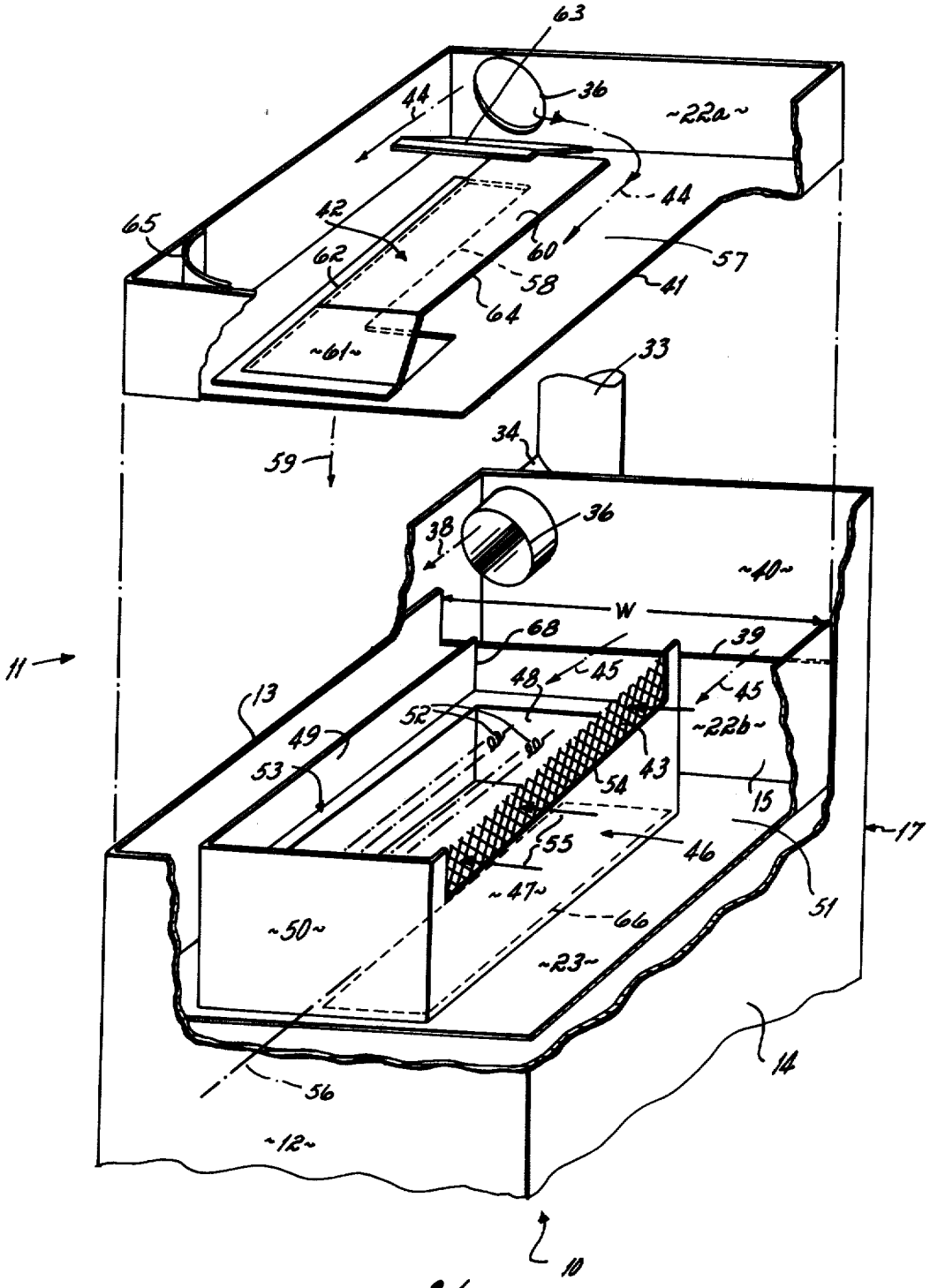
FIG. 3 is an exploded perspective view of the hot air compartment structure of the laundry dryer.

A heater housing 46 is positioned with the lower subchamber **22*b* of the attic chamber 22. The heater housing 46 is rectangular in cross sectional configuration, and includes four sidewalls 47–50 extending between the attic chamber's base floor 23 and intermediate floor 41. Note particularly, as illustrated in FIG. 3, that the heater housing's sidewalls 47–50 are spaced inwardly from the sidewalls 12–15 of the attic chamber 22. This defines a preheat chamber 51 for fresh make-up air since the make-up air inlet port 39 is defined in the rear wall 15 of the attic chamber 22. Further, and since the make-up air introduced into the preheat chamber 51 through the make-up air duct inlet port is introduced in a generally horizontal flow path, as illustrated by phantom arrows 45, the make-up air enters the preheat chamber 51 across the width W of the preheat chamber 51**.

The heater housing 46 mounts, on the interior thereof, heat source means that, in preferred form, is comprised of electrical heater elements 52 fixed to heater frame 53, the heater frame 53 being mounted to the inside surface of the heater housing's wall 47–50. The heater elements 52 span the rectangular heater housing 46 between short end walls 48, 50, and are connected, by electrical means not shown, with a power source in the usual fashion. Note that the electrical heater means 52 is disposed in a generally horizontal plane. The heater housing 46 also defines a make-up air inlet port structure 54 in one of the housing's sidewalls 47. The make-up air inlet port structure 54 is in a generally vertical plane, since it is defined by the generally vertical sidewall 47, and is located in a plane generally normal to the plane of make-up air inlet port 39 in the housing's rear wall 15. Because the make-up air inlet port 54 in the heater housing 46 is generally vertical, the make-up air is directed into the heater housing's interior in a generally horizontal flow path fashion, see phantom arrows 55, from the make-up air preheat chambers 51. Note further that the make-up inlet port structure 54 is of a generally elongated configuration disposed immediately under the attic chamber's intermediate floor 41, is therefore disposed above the generally horizontal heater elements 52, positioned to one side of a center vertical phantom plane 56 through the heater housing 46, and is covered by screen 43. This elongated port structure 54 provides sufficient generally horizontal in-flow 55 of fresh preheated make-up air, and directs that in-flow into the heater housing 46 above the horizontal plane of the electrical heater elements 52 therein.

The upper subchamber **22*a* of the attic chamber 22 is, in effect, a preheat chamber 57 for the recirculated exhaust air flow 25, 38. The upper subchamber 22*a* defines a recirculated exhaust air inlet port in the form of an elongated or generally rectangular opening 58 in the attic chamber's intermediate floor 41. Note particularly that this recirculated exhaust air inlet port 58 is defined in a generally horizontal plane, and is adapted to direct the recirculated exhaust air from its preheat chamber 57 in a generally vertically downward flow path 59 fashion into the heater housing 46. The recirculated air inlet port 58 is generally positioned to the other side of the vertically center phantom plane 56 from that side on which the make-up air inlet port 54 is positioned when the hot air compartment 11 is viewed from the top as shown in FIG. 3 or from the front as shown in FIG. 1. Preferably, the recirculated exhaust air inlet port 58 area comprises not greater than about one-half the area of the attic chamber's intermediate floor 41 area outlined by the heater housing's sidewalls 47–50. Further, and importantly, the L-shaped port 58 is L-shaped in order to preclude a potential hot spot from developing in the electric heater elements 52. The make-up air flow 24 enters through inlet port 39 in the housing's rear wall 15, and thereafter is directed into heater housing 46 through screened port 54 in the sidewall 47 as shown by air flow 55 and through access port 68 in rear wall 48 as shown by air flow 45. The air flow 45 velocity decreases as it moves toward the front wall 50 of the heater housing 46, thereby causing the possibility of a potential hot spot in the heater elements 52 at the front wall 50, sidewall 49 corner. The port 58 is extended in L-shaped configuration at this corner 50, 49 in order to provide recirculated air flow 44** through this corner.

Figure 2:
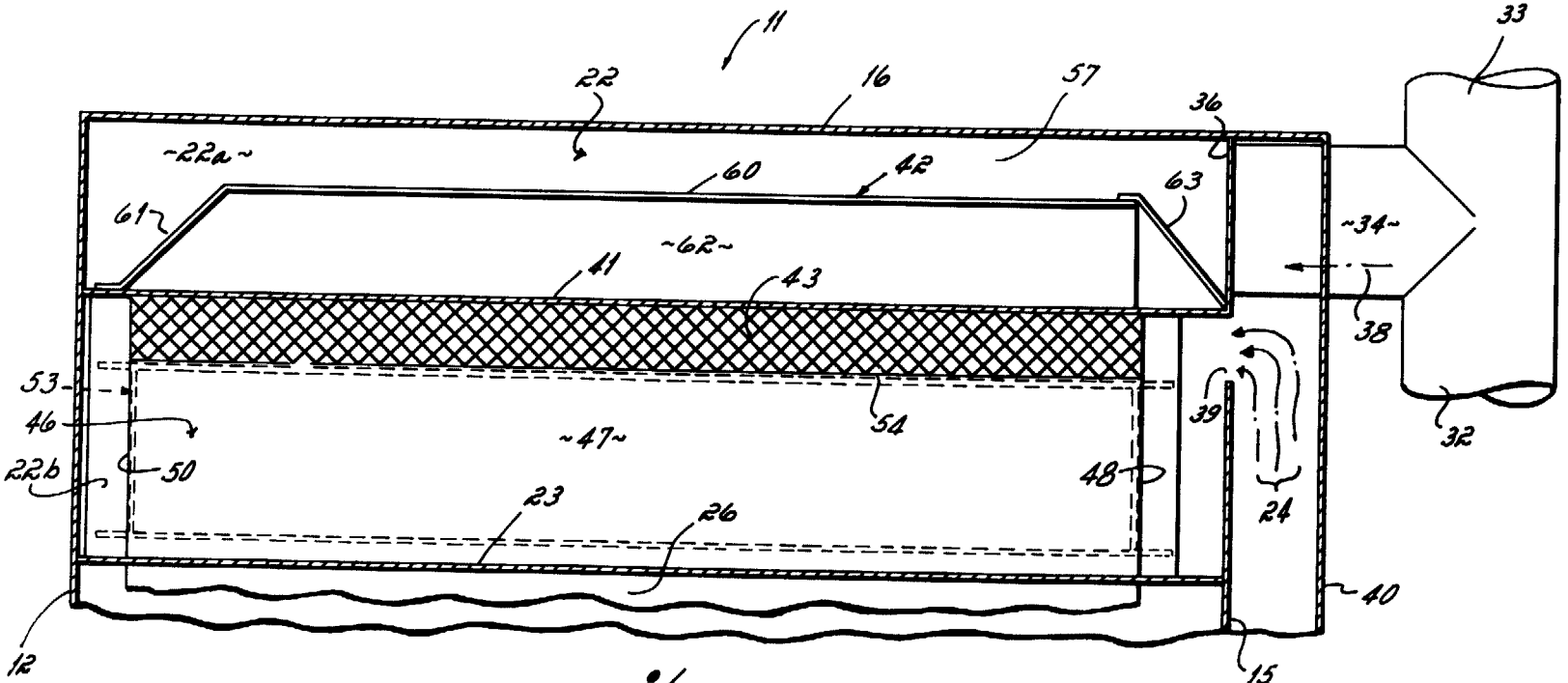
FIG. 2 is a cross-sectional view taken along line 2—2 of FIG. 1.

The upper subchamber **22*a* of the attic chamber 22 also includes a deflector hood 42 positioned above the recirculated exhaust air inlet port 58 so as to deflect throughout the upper subchamber the recirculated exhaust air introduced into that subchamber through the recirculated exhaust air duct structure 34, 36, see FIGS. 1–3. The deflector hood 42 is comprised of a roof 60 and three sidewalls 61–63, the three side walls being connected to the attic chamber's intermediate floor 41 and the roof 60 being spaced from the ceiling 16 of the attic chamber 22. Note the roof 60 and sidewalls 61–63 are preferably rigid to generally overlie the intermediate floor 41 area outlined by the heater housing's sidewalls 47–50. The recirculated exhaust air flows between the gap G defined between the hood's roof 60 and the intermediate floor 41 prior to passing through recirculated air inlet port 58. Note that the recirculated exhaust air feed port 36 is connected with the upper subchamber 22*a* behind the rear 62 wall of the deflector hood. Further, the front edge 64 of the deflector hood 42 is positioned on one side of the heater housing's vertical phantom center plane 56, and the hood's rear wall 62 is positioned on the other side of that vertical phantom center plane. This insures that the recirculated air flow path 44, as introduced into the upper subchamber 22*a* from the recirculated air feed port 36, will contact in optimum fashion the relatively hot intermediate floor 41, and both sides of the hood's roof 60** and sidewalls 61–63 eventually passing through the recirculated exhaust air inlet port 58 structure into the heater housing 46. The sidewall 63 also serves as a deflector of air flow 44 so that the air path does not enter directly into opening 58 through gap G without benefit of being preheated. A first curved deflector plate 65 is located in that corner of the upper subchamber 22*a* opposite the recirculated exhaust air feed port 36, and a second curved deflector plate (not shown) is located in the corner defined by front wall 12 and sidewall 14 in upper subchamber 22*a*, also for the purpose of guiding flow of the recirculated exhaust air throughout the upper subchamber.

The base floor 23 of the attic chamber 22 also defines an outlet port 66, the outlet port being connected with the shroud 20, 21 for the dryer's drum 18 by duct 26. As illustrated particularly in FIG. 3, the outlet port 66 is generally positioned to the same side of the center vertical phantom plane 56 of the heater housing 46 as the make-up air inlet port 54 is positioned. Further in this regard, the outlet port 66 area comprises not greater than about one-half the area of the base floor 23 outlined by the heater housing's sidewalls 47–50. Thus, the recirculated air inlet port 58 area and the outlet port 66 area are substantially the same, and the two ports 58, 66 are located on opposite sides of the center vertical phantom plane 56 of the heater housing 46. This general structural configuration of the heater housing 46, in combination with the location of the make-up air inlet port 54 to the heater housing, insures that the recirculated exhaust air and the fresh make-up air will be intimately admixed within the heater housing due to the generally normal intersection of those two air flow paths 59, 55 within the heater housing above the horizontal electrical heater elements 48, as well as insures heating of the intimately admixed air flows to the desired elevated temperature level for use within the dryer's drum 18.

In use, fresh make-up air 24 from exterior to the dryer's housing 17 is introduced into the dryer's lower subchamber 51 from along rear wall 15 of the dryer's housing. This fresh make-up air 24 is preliminarily preheated to an extent, prior to reaching the lower subchamber 51, as the rear wall 15 of the dryer's housing is generally warmer than the atmospheric environment. The fresh make-up air 24 introduced into the lower subchamber 51 is preheated to a significant degree within that subchamber because the subchamber is hot due to its proximity to the heater housing 46, and the heat given off thereby. Recirculated warm air 25, which has already passed through the dryer's drum 18, is introduced into the upper subchamber 57 through recirculation duct 34, that duct discharging the recirculated air in generally horizontal flow path fashion 44 behind the deflector hood 42 located in that upper subchamber. The deflector hood 42 is disposed above the heater housing 46 in the lower subchamber 51 so that same is heated by the heater elements 52 to a significant degree. The recirculated exhaust air 38 flows over the deflector hood 42 and circulates within the upper subchamber 57 prior to passing through gap G between the deflector hood's roof and the intermediate floor 41, thereby preheating the recirculated exhaust air 38 to a significant degree.

After the recirculated exhaust air 38 has been preheated in the upper subchamber due to contact thereof with the attic chamber's ceiling 16, intermediate floor 41, and deflector hood 42, and after the fresh make-up air 24 has been preheated in the lower subchamber 51 due to contact thereof with the exterior surface of the heater housing 46 and the attic chamber's intermediate floor 41, and base floor 23, both air flows pass into the heater housing itself. The recirculated exhaust air flow 59 passes into the heater housing 46 in a generally vertically downward flow path through recirculated air inlet port 58, and the fresh make-up air 55 passes into the heater housing in a generally horizontal flow path through the generally vertically oriented fresh make-up air inlet port 54, see FIG. 1. These two flow paths 59, 55 intersect in generally normal or perpendicular fashion above the heater elements 52 within the heater housing 46, thereby providing initimate admixture at that location prior to passing down through the heater elements. The intimately admixed recirculated exhaust air and fresh make-up air, after being heated to the elevated temperature level by the heater elements 52, passes outwardly through the outlet port 66 in the attic chamber's floor 23 and is thereafter directed vertically downward through duct 26 into the dryer's drum 18. The cooperative combination of the various structural elements in this hot air compartment structure 11 serve to optimize heat transfer from the heater elements 52 to the recirculated exhaust air and fresh make-up air, and also function to make use of residual heat in the recirculated exhaust air which would otherwise be lost to atmosphere.

Having described in detail the preferred embodiment of my invention, what I desire to claim and protect by Letters Patent is:

1. A method of heating recirculated exhaust air and fresh make-up air in a laundry dryer, said method comprising the steps of dividing an attic chamber of said laundry dryer into upper and lower subchambers separated by an intermediate floor, the upper subchamber defining a preheat chamber for recirculating exhaust air, positioning a heater housing within the lower subchamber, the heater housing extending between the base floor and the intermediate floor, at least a portion of the heater housing's side walls being spaced inwardly from the attic chamber's side walls to define a preheat chamber for the fresh make-up air, the heater housing including heat source means to heat fresh make-up air and recirculated exhaust air together and simultaneously to an elevated temperature level, recirculating exhaust air into the upper subchamber, and directing make-up air into the lower subchamber, for preheating the recirculated exhaust air and the fresh make-up air to above the temperature at which each entered the respective subchambers, directing the make-up air into the heater housing in generally horizontal flow path fashion from the lower subchamber, and directing the recirculated exhaust air into the heater housing in generally vertically downward flow path fashion from the upper subchamber, the generally vertical recirculated exhaust air flow and generally horizontal make-up air flow being simultaneously heated and admixed, together and intimately, within the heater housing, and directing the intimately admixed and heated recirculated exhaust air and make-up air generally vertically downward into the dryer's drum from the heater housing.

2. A method as set forth in claim 1, the heat source means comprising electric heater elements positioned generally horizontally within the heater housing, the make-up air and recirculated air being directed into the heater housing above at least a portion of the heater elements.

3. A laundry dryer having a hot air compartment structure that heats recirculated exhaust air and fresh make-up air, said dryer including a rotatable drum and a housing, said hot air compartment structure comprising an attic chamber defined by a base floor, a ceiling, and side walls, said ceiling and side walls also partially defining said dryer's housing, said attic chamber being separated into upper and lower subchambers by an intermediate floor that extends between said side walls, said upper subchamber providing a preheat chamber for recirculated exhaust air that is defined by said ceiling, side walls, and intermediate floor, and said lower subchamber providing a preheat chamber for fresh make-up air, a heater housing positioned within said lower subchamber, said heater housing being defined by side walls extending between said base floor and said intermediate floor with at least a portion of said heater housing's side walls being spaced inwardly from said attic chamber's side walls, said intermediate floor, base floor, attic chamber's side walls and heater housing's side walls cooperating to define said preheat chamber for fresh make-up air, said make-up and recirculated air preheat chambers thereby being separate one from the other, electric heater elements positioned within said heater housing between said intermediate floor and said base floor, said heater elements being provided to heat both fresh make-up air and recirculated exhaust air to a temperature level elevated above that established in said preheat chambers, the make-up and exhaust air flows from said preheat chambers being intimately admixed prior to and while passing through said electric heater elements, recirculated exhaust air duct structure connected with said recirculated air preheat chamber, and make-up air duct structure connected with said make-up air preheat chamber, said recirculated exhaust air duct structure directing the recirculated exhaust air flow, and said make-up air duct structure directing the make-up air flow, into said preheat chambers for preheating the recirculated exhaust air and the make-up air to a temperature above the respective temperature of each at the time of entry into said respective preheat chambers, a make-up inlet port structure defined in said heater housing's side walls above said electric heater elements, said make-up air inlet port structure being oriented in a generally vertical plane and being adapted to direct said make-up air into said heater housing above said electric heater elements in generally horizontal flow path fashion from said make-up air preheat chamber, a recirculated exhaust air inlet port structure defined in said intermediate floor above said electric heater elements, said recirculated exhaust air inlet port structure being defined in a generally horizontal plane and being adapted to direct said recirculated exhaust air into said heater housing in generally vertical downward flow path fashion from said recirculated air preheat chamber, said generally vertical recirculated exhaust air flow and generally horizontal make-up air flow being admixed intimately with said heater housing prior to and during the passing of those combined air flows through said electric heater elements within said heater housing, and outlet port structure defined in said base floor, said outlet port structure being connectable with said dryer's drum, the intimately admixed and heated combined flows of recirculated exhaust air and make-up air being directed generally vertically downward into the dryer's drum through said outlet port structure.

4. A laundry dryer as set forth in claim 3, said make-up air inlet port being generally positioned to one side of a center vertical phantom plane through said heater housing, and said recirculated exhaust air inlet port being generally positioned to the other side of said center vertical phantom plane.

5. A laundry dryer as set forth in claim 4, said outlet port structure being generally positioned to the same side of said center vertical phantom plane as said make-up air inlet port is positioned.

6. A laundry dryer as set forth in claim 5, each of said make-up air inlet port, recirculated exhaust air port and outlet port structures being of a generally elongated configuration with a greater length than width, said lengths being aligned generally parallel one to the other.

7. A laundry dryer as set forth in claim 4, said hot air compartment structure further comprising a deflector hood located in said upper subchamber, said hood being positioned above said recirculated exhaust air inlet port structure to cooperate with said recirculated exhaust air duct structure so as to deflect the recirculated exhaust air introduced into said upper subchamber throughout said upper subchamber prior to allowing said exhaust air to flow into said heater housing.

8. A laundry dryer as set forth in claim 7, said deflector hood comprising a roof and side walls, said side walls being connected to said intermediate floor and said roof being spaced from said ceiling, the recirculated exhaust air flowing between a gap defined between said roof and said intermediate floor prior to passing through said recirculated air inlet port structure, and said recirculated exhaust air duct structure being connected with said upper subchamber so as to introduce the recirculated exhaust air in generally horizontal flow path fashion into said upper subchamber, said connection being behind said gap so that the recirculated air must pass from behind said hood to in front of said hood prior to passing through said recirculated air inlet port structure.

* * * * *